US011000448B2

(12) United States Patent
Nichols

(10) Patent No.: US 11,000,448 B2
(45) Date of Patent: May 11, 2021

(54) HANDHELD MOTORIZED FACIAL BRUSH HAVING SPECIALIZED TORQUE TRANSFER CLIP

(71) Applicant: Thomas Nichols, Laguna Niguel, CA (US)

(72) Inventor: Thomas Nichols, Laguna Niguel, CA (US)

( * ) Notice: Subject to any disclaimer, the term of this patent is extended or adjusted under 35 U.S.C. 154(b) by 793 days.

(21) Appl. No.: 15/422,309

(22) Filed: Feb. 1, 2017

(65) Prior Publication Data

US 2017/0202732 A1 Jul. 20, 2017

Related U.S. Application Data

(63) Continuation-in-part of application No. 13/603,081, filed on Sep. 4, 2012, now Pat. No. 9,579,250, and a (Continued)

(51) Int. Cl.
*A61H 23/02* (2006.01)
*A46B 13/02* (2006.01)

(Continued)

(52) U.S. Cl.
CPC ..... *A61H 23/02* (2013.01); *A46B 5/0095* (2013.01); *A46B 7/04* (2013.01); *A46B 9/005* (2013.01); *A46B 13/008* (2013.01); *A46B 13/02* (2013.01); *A46B 13/023* (2013.01); *A46B 15/0044* (2013.01); *A61H 7/005* (2013.01); *A61H 23/0263* (2013.01); *A46B 2200/102* (2013.01); *A61H 2201/0153* (2013.01);

(Continued)

(58) Field of Classification Search
CPC ..... A61H 2201/1685; A61H 7/005; A61H 7/002; A61H 7/004; A61H 23/02; A46B 2200/102; A46B 15/0075; A46B 5/0095; A46B 7/04
See application file for complete search history.

(56) References Cited

U.S. PATENT DOCUMENTS

D196,227 S 9/1963 Polatchek
D204,921 S 5/1966 McNair (Continued)

FOREIGN PATENT DOCUMENTS

CN 301929100 5/2012
CN 30213979 10/2012

(Continued)

*Primary Examiner* — Timothy A Stanis
(74) *Attorney, Agent, or Firm* — Knobbe, Martens, Olson & Bear, LLP

(57) ABSTRACT

A Handheld Motorized Facial Brush Having Specialized Torque Transfer Clip. The heads interface with a conventional handpiece so that the facial brush or other facial treatment head can be removed and replaced with a head chosen from a group of treatment heads. The handpiece has a sealed, washable head portion that can be activated to rotate. Each treatment head or treatment assembly includes a torque transfer clip that provides biasing force between the handpiece and the head, but at the same time results in additional vibration being transferred from the vibration generator in the handpiece to the treatment head. The torque transfer clip also allows for some flex between the treatment head and the handpiece.

19 Claims, 13 Drawing Sheets

Related U.S. Application Data continuation-in-part of application No. 29/544,443, filed on Nov. 3, 2015, now Pat. No. Des. 803,572.

(51) Int. Cl.

| | |
|---|---|
| ***A46B 13/00*** | (2006.01) |
| ***A46B 15/00*** | (2006.01) |
| ***A46B 9/00*** | (2006.01) |
| ***A46B 7/04*** | (2006.01) |
| ***A61H 7/00*** | (2006.01) |
| ***A46B 5/00*** | (2006.01) |

(52) U.S. Cl.

CPC ..... *A61H 2201/0157* (2013.01); *A61H 2201/1207* (2013.01); *A61H 2201/1685* (2013.01); *A61H 2205/022* (2013.01)

(56) References Cited

U.S. PATENT DOCUMENTS

| | | | | |
|---|---|---|---|---|
| 5,007,168 | A | 4/1991 | Messinger et al. | |
| 5,423,102 | A | 6/1995 | Madison | |
| D366,703 | S | 1/1996 | Huen | |
| 5,577,324 | A | 11/1996 | Tanaka | |
| 5,891,063 | A | 4/1999 | Vigil | |
| 6,170,108 | B1 | 1/2001 | Knight | |
| D452,044 | S | 12/2001 | Goetschi | |
| D493,621 | S | 8/2004 | Wilson | |
| D500,168 | S | 12/2004 | Ho | |
| D533,353 | S | 12/2006 | Daubenspeck | |
| D549,964 | S | 9/2007 | Roth | |
| 7,306,569 | B2 | 12/2007 | LaJoie | |
| 7,320,691 | B2 | 1/2008 | Pitcher | |
| D569,523 | S | 5/2008 | Hsieh | |
| 7,370,420 | B2 | 5/2008 | Shimizu | |
| 7,386,906 | B2 | 6/2008 | Roth et al. | |
| D573,346 | S | 7/2008 | Daubenspeck | |
| 7,469,703 | B2 | 12/2008 | France | |
| D612,612 | S | 3/2010 | Harris | |
| 7,707,674 | B2 | 5/2010 | Schonewille et al. | |
| 7,743,508 | B2 | 6/2010 | Shimizu, III | |
| 7,789,092 | B2 | 9/2010 | Akridge et al. | |
| 7,810,201 | B2 | 10/2010 | Braun | |
| D636,933 | S | 4/2011 | Newman | |
| 7,937,792 | B2 | 5/2011 | Munn et al. | |
| D645,565 | S | 9/2011 | Smith | |
| D646,487 | S | 10/2011 | Leppla | |
| D648,441 | S | 11/2011 | Rivero | |
| D652,169 | S | 1/2012 | Yoon | |
| D693,932 | S | 11/2013 | Nichols | |
| D713,150 | S | 9/2014 | Maurin | |
| D715,555 | S | 10/2014 | Hosler | |
| D728,242 | S | 5/2015 | Kim | |
| D749,325 | S | 2/2016 | Middendorp | |
| D753,400 | S | 4/2016 | Khoun | |
| 9,314,095 | B2 | 4/2016 | Hwang | |
| D760,498 | S | 7/2016 | Kim | |
| D764,173 | S | 8/2016 | Nichols | |
| 2002/0084562 | A1* | 7/2002 | Kelsey | F16F 1/326 267/166 |
| 2002/0157257 | A1 | 10/2002 | Oswald | |
| 2005/0066996 | A1 | 3/2005 | France et al. | |
| 2005/0184601 | A1* | 8/2005 | Kweon | B06B 1/045 310/36 |
| 2005/0199265 | A1 | 12/2005 | France et al. | |
| 2006/0168746 | A1 | 8/2006 | Guyuron et al. | |
| 2006/0285910 | A1* | 12/2006 | Khubani | A46B 11/0013 401/6 |
| 2007/0124936 | A1 | 6/2007 | Okabe | |
| 2009/0049630 | A1* | 2/2009 | Haigh | A46B 5/0075 15/145 |
| 2009/0217471 | A1 | 9/2009 | Weinberger | |
| 2010/0275446 | A1 | 11/2010 | Schmitt et al. | |
| 2011/0030220 | A1 | 2/2011 | Shimizu, III | |
| 2011/0138563 | A1 | 6/2011 | Phgura | |
| 2011/0184499 | A1 | 7/2011 | Radi | |
| 2012/0104120 | A1* | 5/2012 | Holt | F16F 1/328 239/533.2 |
| 2012/0233798 | A1* | 9/2012 | Brewer | A46B 9/06 15/160 |
| 2013/0023805 | A1* | 1/2013 | Ungemach | A61H 7/005 601/114 |
| 2013/0046212 | A1 | 2/2013 | Nichols | |
| 2013/0060176 | A1 | 3/2013 | Nichols | |
| 2015/0173842 | A1 | 6/2015 | Carlucci | |
| 2015/0182078 | A1* | 7/2015 | Miller | A47K 7/04 15/22.1 |
| 2015/0257521 | A1 | 9/2015 | Hendler | |

FOREIGN PATENT DOCUMENTS

| | | |
|---|---|---|
| CN | 302181367 | 11/2012 |
| CN | 302181368 | 11/2012 |
| CN | 302711278 | 1/2014 |
| CN | 303173779 | 4/2015 |
| CN | 303173780 | 4/2015 |
| CN | 303323096 | 8/2015 |
| JP | D1270718 | 5/2006 |

* cited by examiner

HANDHELD MOTORIZED FACIAL BRUSH HAVING SPECIALIZED TORQUE TRANSFER CLIP

This application is a continuation-in-part of application Ser. No. 13/603,081, filed Sep. 4, 2012, and Ser. No. 29/544,443, filed Nov. 3, 2015, both now pending.

BACKGROUND OF THE INVENTION

1. Field of the Invention

This invention relates generally to facial skin care appliances and, more specifically, to a Handheld Motorized Facial Brush Having Specialized Torque Transfer Clip.

2. Description of Related Art

Facial massage and skin treatment devices are widely known in the art. One particular functional feature that has not been widely implemented is the device having a face-hugging or "floating" treatment head. The advantage of a floating head is that the face of the treatment head will tend to remain in contact with the user's skin while traversing the irregular topography that tends to define a person's face in particular.

Vigil, U.S. Pat. No. 5,891,063 is a "Skin Rejuvinating System" that includes a rotating bi-level brush. No floating capability. Harris, U.S. Pat. No. D612,612 discloses a design that appears to be a rotating and somewhat pivoting treatment brush. Roth, U.S. Pat. No. D549,964 shows the shape of a motorized facial brush without suggesting any pivoting motion. Akridge, U.S. Pat. No. 7,789,092 and Roth, U.S. Pat. No. 7,386,906 are related to the Roth design patent reference, but fail to suggest any pivoting motion or the light/vibration/microcurrent emissions. Pitcher, U.S. Pat. No. 7,320,691 discloses an "Apparatus and Method for Acoustic/Mechanical Treatment of Early Stage Acne"—while this reference does relate to the field of the instant invention, but it does not disclose any pivoting or floating head design.

Careful review of these prior devices reveals that the following references fails to suggest a device with detachable and interchangeable treatment heads, wherein the attachment mechanism provides a positive connection between the handpiece and the treatment head, while also allowing some axial flexing between the treatment head and the handpiece.

SUMMARY OF THE INVENTION

In light of the aforementioned problems associated with the prior devices and assemblies, it is an object of the present invention to provide a Handheld Motorized Facial Brush Having Specialized Torque Transfer Clip. The heads should interface with a conventional handpiece so that the facial brush or other facial treatment head can be removed and replaced with a head chosen from a group of treatment heads. The handpiece should have a sealed, washable head portion. Each treatment head or treatment assembly should include a torque transfer clip that provides biasing force between the handpiece and the head, but at the same time result in additional vibration being transferred from the vibration generator in the handpiece to the treatment head. The torque transfer clip should also allow for some flex between the treatment head and the handpiece.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Handheld Motorized Facial Brush Having Specialized Torque Transfer Clip.

Figure 1:
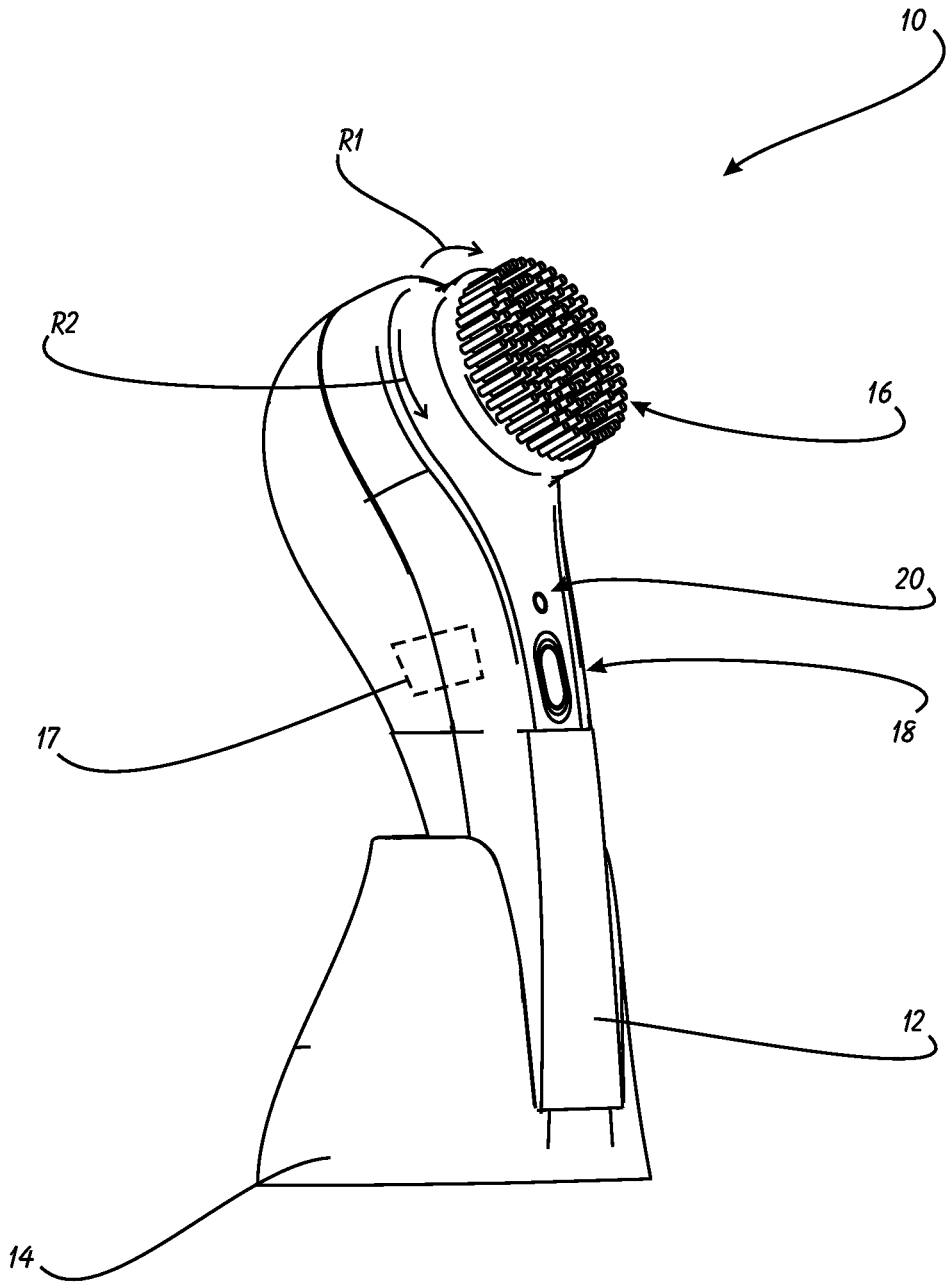
FIG. 1 is a perspective view of a preferred embodiment of the skin treatment device having the torque transfer subassembly of the present invention in a re-charging stand.

The present invention can best be understood by initial consideration of FIG. 1.[1] FIG. 1 is a perspective view of a preferred embodiment of the skin treatment device having the torque transfer subassembly 10 of the present invention in a re-charging stand 14. The device 10 has a detachable treatment assembly 16, such as the bristle brush assembly shown here. Other assemblies 16 may have a sponge surface, a smooth silicone face, and/or other materials for treating the user's skin.

[1] As used throughout this disclosure, element numbers enclosed in square brackets [ ] indicates that the referenced element is not shown in the instant drawing figure, but rather is displayed elsewhere in another drawing figure.

The device 10 preferably has an internal vibration generator 17, such as a motor with offset weight or other conventional system such as an electromagnetic coil and magnet. The treatment assembly 16, in addition to transmitting vibration, may rotate in direction R1 or direction R2 via internal and internal motor drive system that is activated when the user depresses power/mode button 18. Indicator light 20 will illuminate and change color depending upon the mode (vibration and/or rotation).

Figure 2:
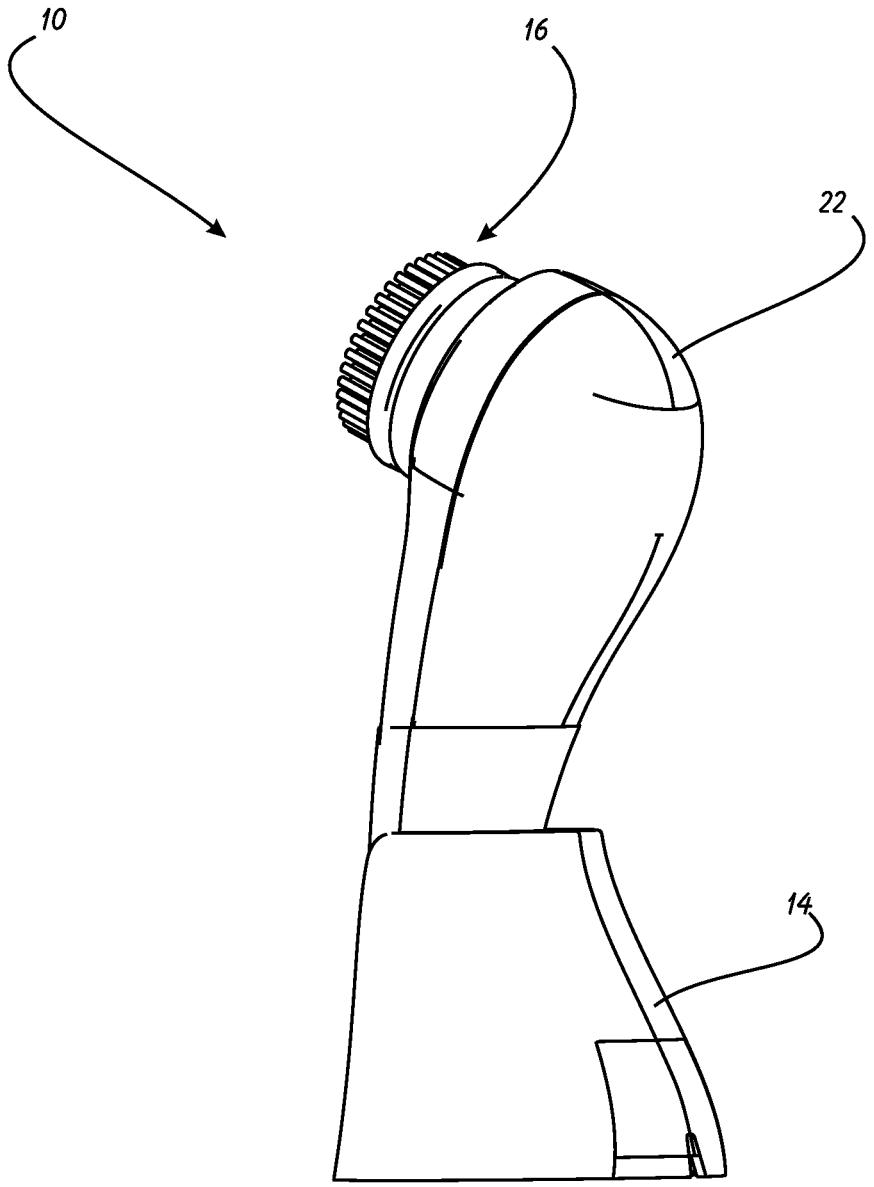
FIG. 2 is a rear perspective view of the device of FIG. 1.
Figure 3:
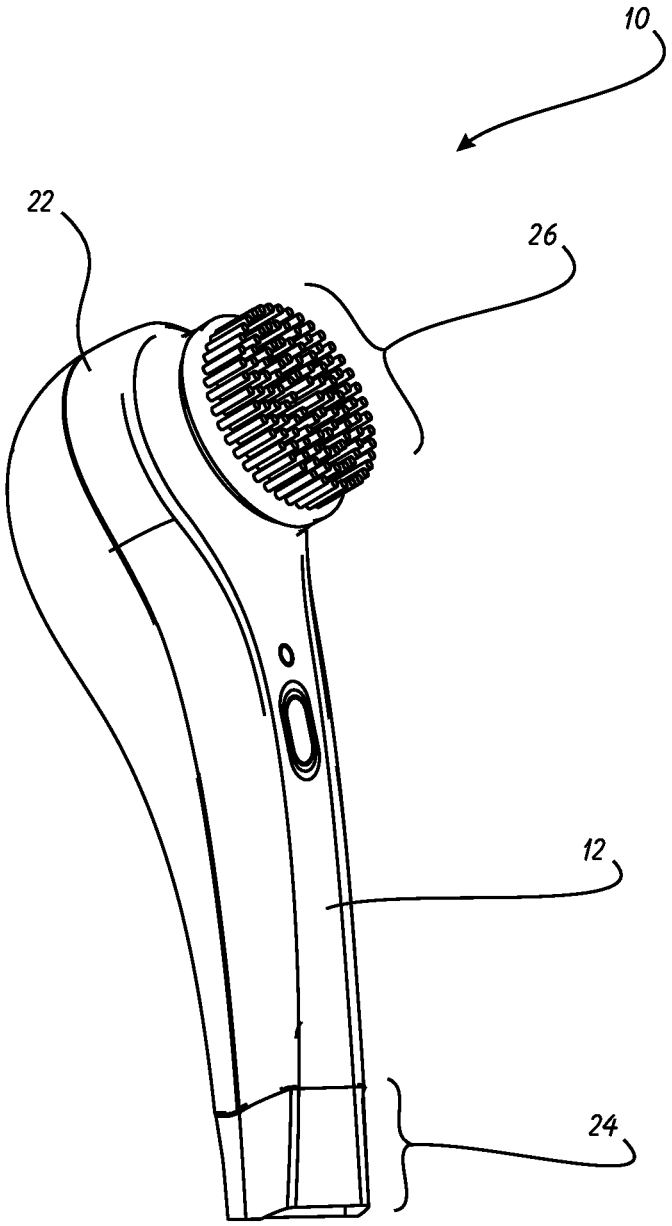
FIG. 3 is a perspective view of the device of FIGS. 1 and 2 without the stand.

FIG. 2 is a rear perspective view of the device 10 of FIG. 1, and FIG. 3 is a perspective view of the device 10 of FIGS. 1 and 2 without the stand [14]. Here, the distal end portion 24 of the handpiece 12 can be seen as it has been removed from the stand [14]. An electrical connection between the two allows the internal battery pack to be charged when the handpiece 12 is inserted into the stand [14].

Figure 4:
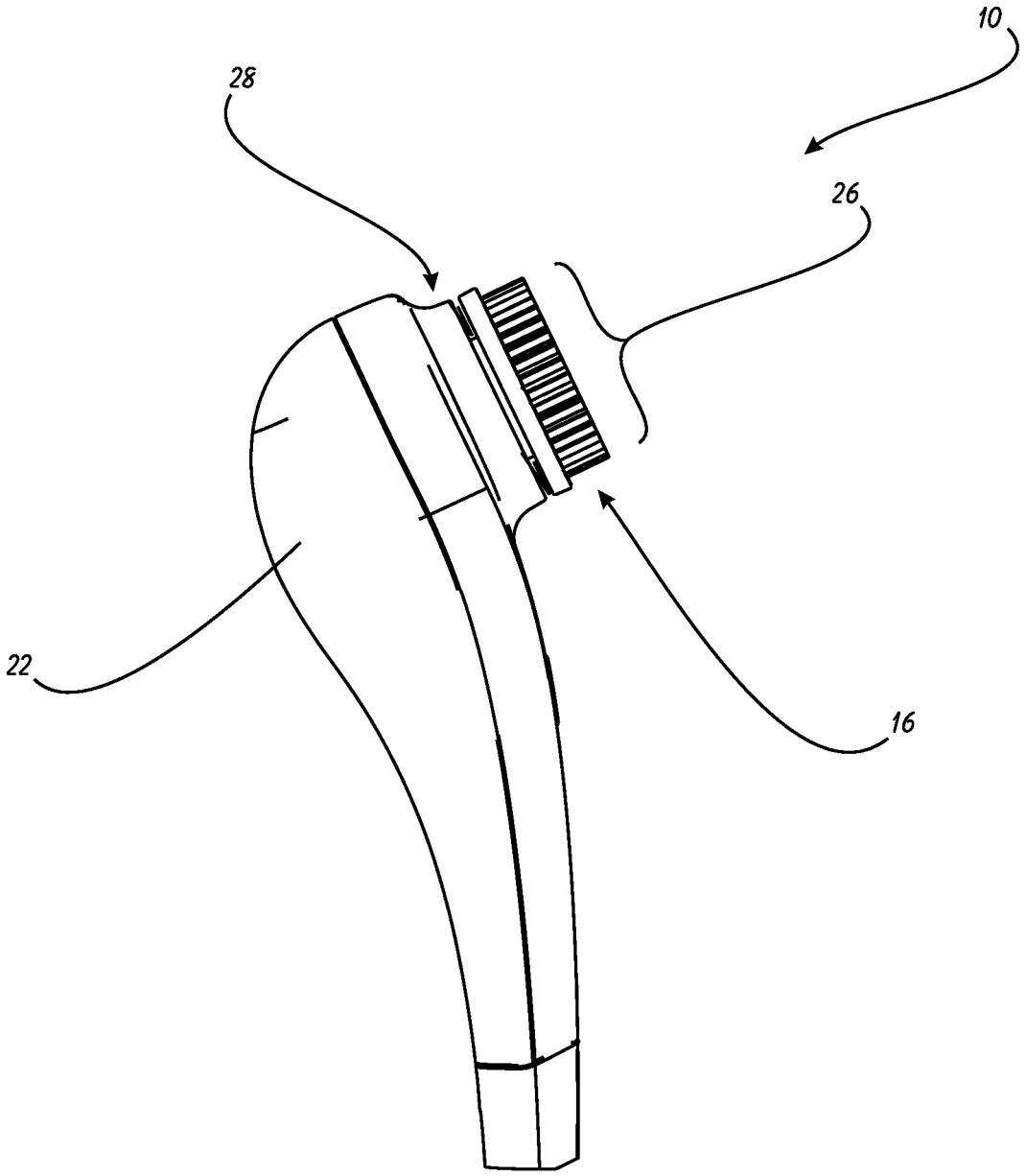
FIG. 4 is a side view of the device of FIG. 3.

FIG. 4 is a side view of the device 10 of FIG. 3. The treatment assembly 16 shown here has a bristle brush treatment element 26 extending from its outward face 28. The truly unique aspects of the device 10 are first introduced in FIGS. 5 and 6.

Figure 5:
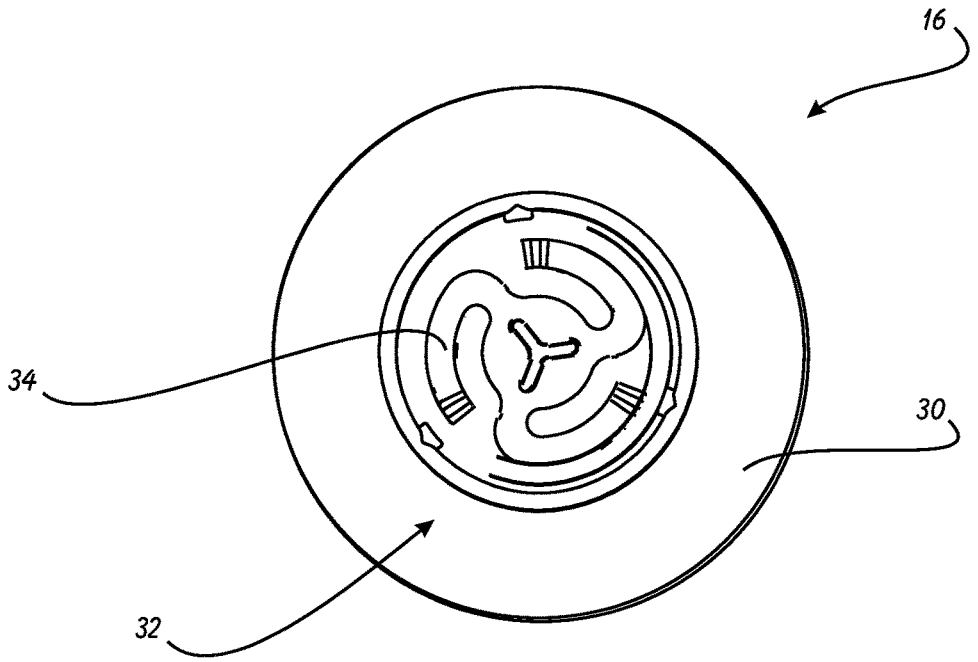
FIG. 5 is a back view of a the treatment assembly of the device of FIG. 1.
Figure 6:
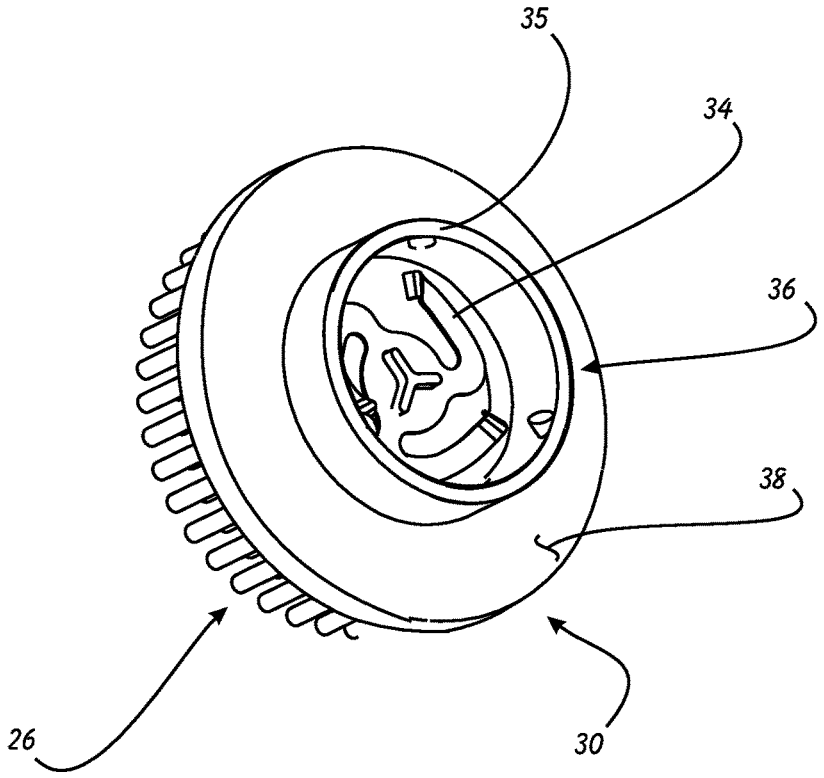
FIG. 6 is a rear perspective view of the assembly of FIG. 5.

FIG. 5 is a back view of a the treatment assembly 16 of the device [10] of FIG. 1, and FIG. 6 is a rear perspective view of the assembly 16 of FIG. 5. There is an attachment subassembly 32 extending backward from the base 30. A torque transfer clip 34 is attached to the base 30. The clip 34 is formed from flat material such as spring steel or the like, and is expected to act to create a biasing force against the handpiece [12] when the subassembly 32 of the assembly 16 is attached thereto.

The back surface 38 is preferably flat so as to not interfere with the head portion [22] of the handpiece [12]. A generally circular peripheral wall 36 extends upwardly from the back surface 38 of the base 30 until it terminates in an upper edge 35. The base 30 and peripheral wall 36 are preferably formed from the same hypoallergenic material as a unitary piece. The treatment element 26 may be either bonded to the base 30 after its formation, or the treatment element 26 may be incorporated into the base 30 when the base 30 is formed. In contrast, the torque transfer clip 34 is typically formed from metal (e.g. spring steel), and is attached to the base 30 after its formation.

Figure 7:
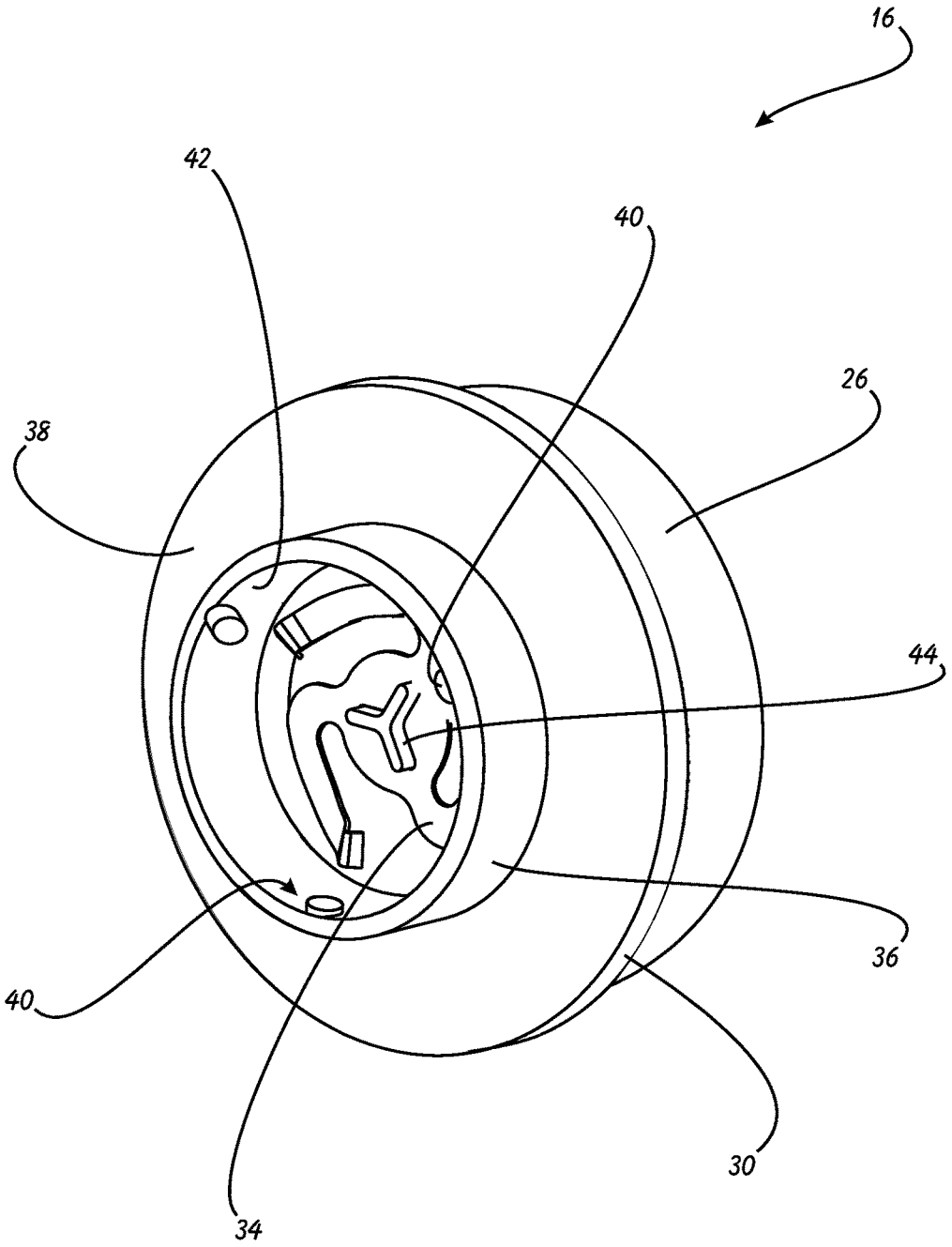
FIG. 7 is a second rear perspective view of the assembly of FIG. 5.

FIG. 7 is a second rear perspective view of the assembly 16 of FIG. 5. In this view, a plurality of locking pegs 40 can be seen to be extending inwardly from the inner surface 42 of the peripheral wall 36 adjacent to its upper edge. As will become clear below, these pegs 40 are configured to interlock with features on the head portion [22] of the device so as to lock the treatment assembly 16 to the head portion [22].

A bonding stem 44 can be seen to be protruding through an aperture [70] formed in the torque transfer clip 34. This bonding stem 44 preferably has two or more "fins" extending from its center. These fins serve to align and center the torque transfer clip 34 within the peripheral wall 36, while also preventing any relative rotation between the clip 34 and the base 30. During assembly, the clip 34 is placed over the stem 44, after which the stem 44 can be slightly melted in order to permanently attach the clip 34 to the base 30. It is further noted that a sponge treatment element 26 is attached to the opposing side of the base 30.

Figure 8:
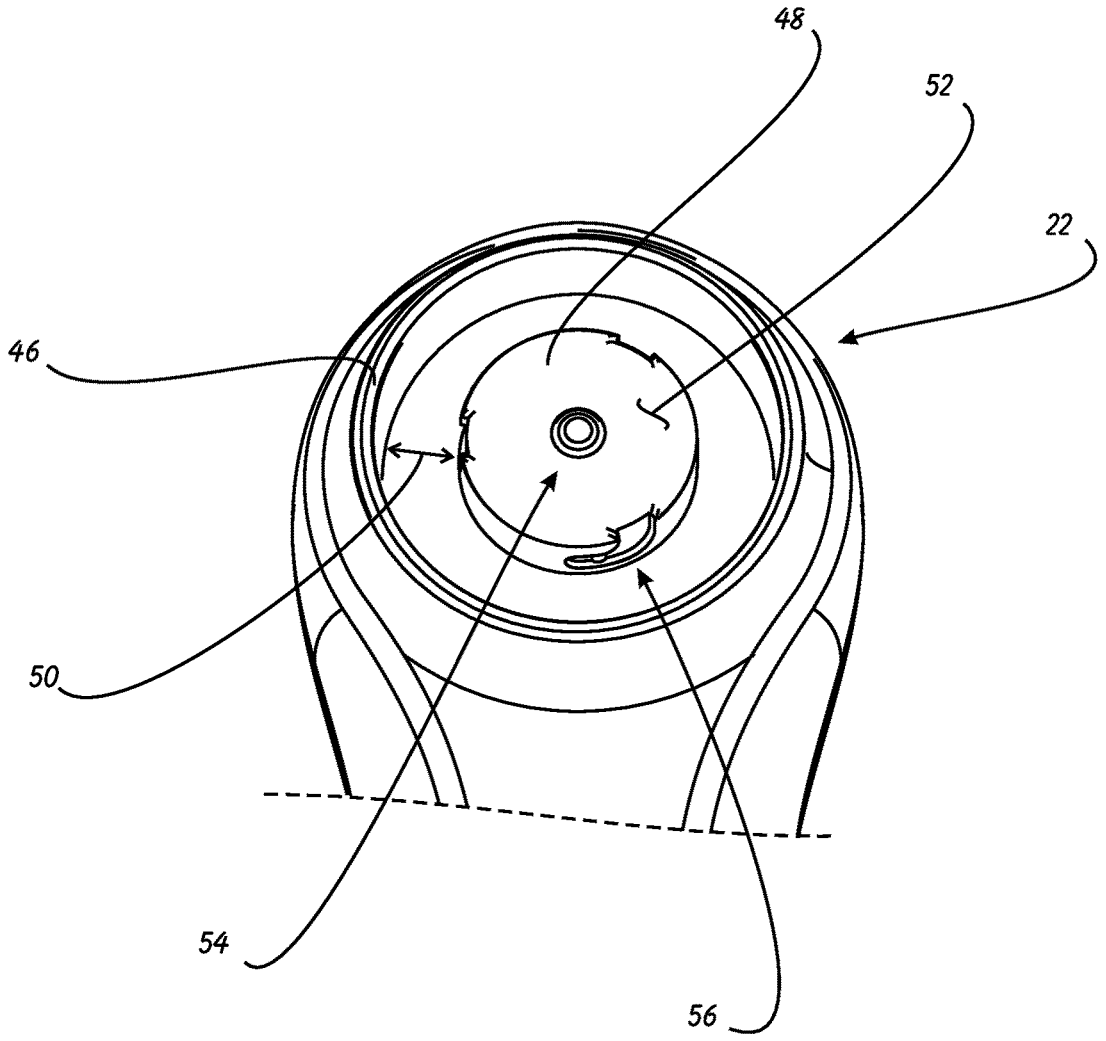
FIG. 8 is a partial front view of the handpiece of the device of FIG. 1.

FIG. 8 is a partial front view of the handpiece [12] of the device [10] of FIG. 1, depicting only the head portion 22 area. The face of the head portion 22 is defined by a central hub 48 extending out and terminating in a face 52. A central protrusion 54 may or may not further extend from the face 52. The hub 48 has a plurality of "L"-shaped locking channels 56 formed around its periphery at locations to cooperate with the locking pegs [40] depicted in FIG. 7.

A peripheral channel 50 surrounds the central hub 48 and terminates in rim 46 at its outer limits. The channel 50 that is configured to accept the peripheral wall [36] therein when the treatment assembly [16] is attached to the head portion 22. This arrangement of the wall [36] surrounding the hub 48 is provided in order to prevent lotions or other liquids from entering the interior of the head portion 22 from the treatment element [26]—to add in the water resistance of the device by adding a second layer of protection to the internal shaft seals provided inside of the hub 48. Further detail is depicted in FIG. 9.

Figure 9:
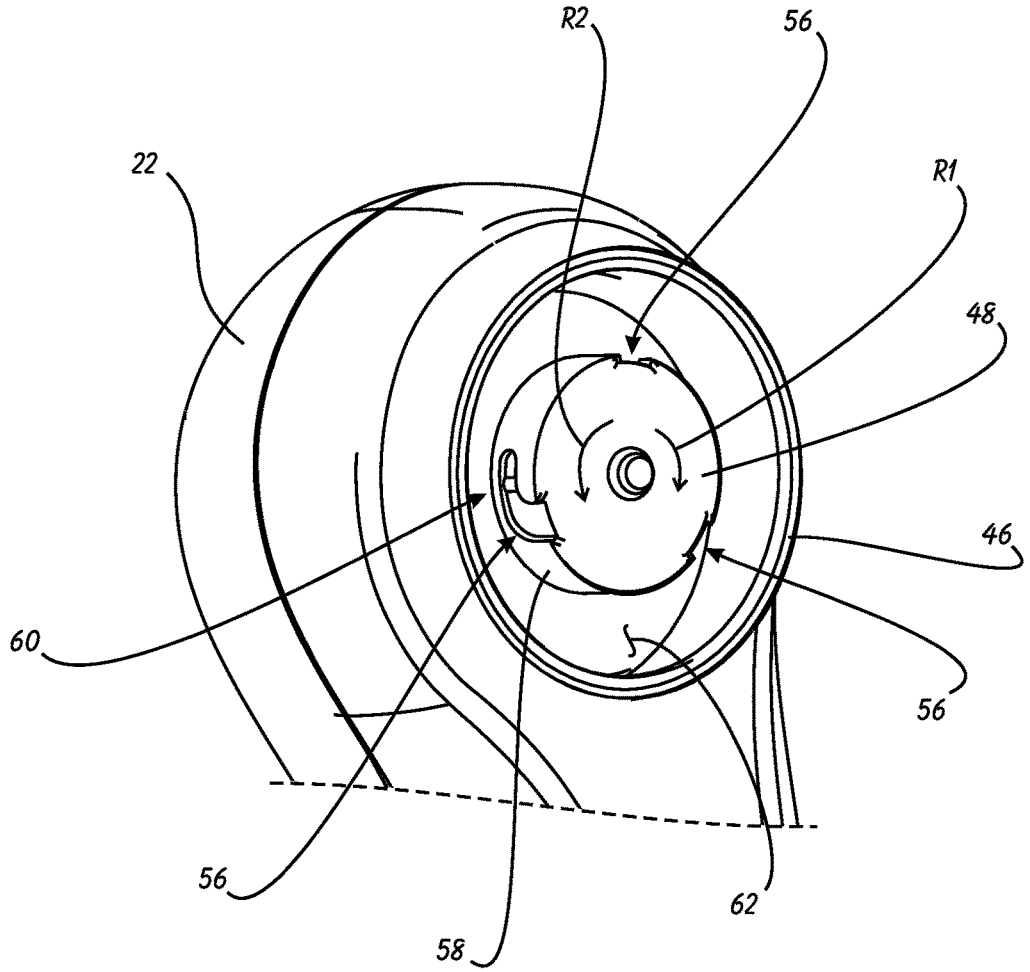
FIG. 9 is a partial right perspective view of the device of FIG. 1.

FIG. 9 is a partial right perspective view of the device [10] of FIG. 1. Here, all three of the locking channels 56 formed into the side face 58 can be seen. Furthermore, each channel 56 could have a transversely-aligned ridge 60 is formed in the channel 56. This ridge 60 towards the end of each channel 56 is provided to interact with the tip of each of the locking pegs 40, so as to resist the pegs 40 being able to pass back over the ridges 56 when the treatment assembly [16] is twisted relative to the hub 48.

Figure 10:
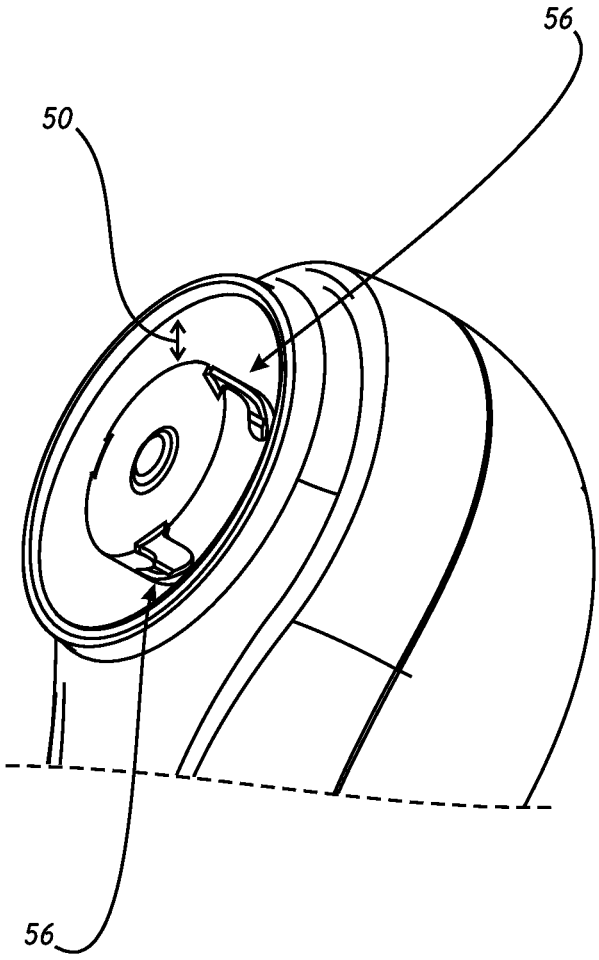
FIG. 10 is a partial left perspective view of the device of FIG. 1.

In some versions, the hub 48 will have an internal motor that can drive it to rotate in direction R1 or R2. In other versions, the hub 48 will be fixed, and only vibration will be transmitted from the handpiece [12] to the hub 48. As discussed previously, the channel bottom surface 62 is recessed sufficiently below the level of the rim 46 so that the entire peripheral wall [36] can be accepted within it. FIG. 10 is a partial left perspective view of the device of FIG. 1.

Figure 11:
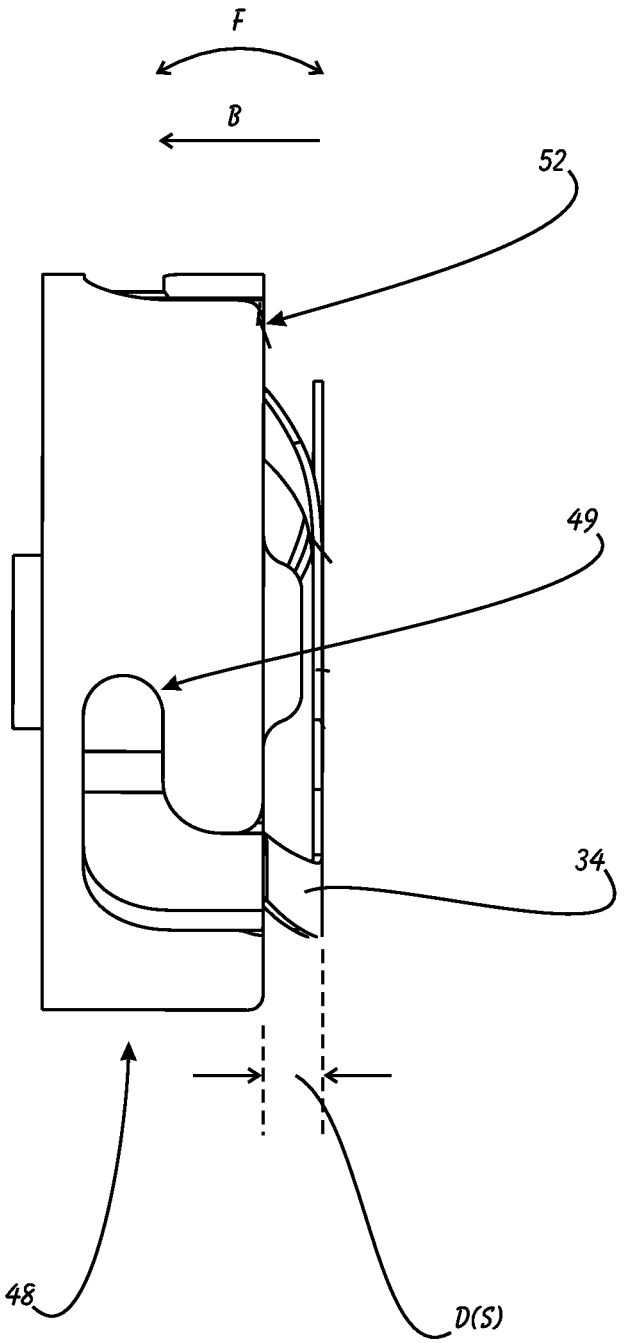
FIG. 11 is a partial side view of the device of FIG. 1.

The interaction between the hub 48 and the clip [34] is depicted in FIG. 11. FIG. 11 is a partial side view of the device [10] of FIG. 1. This partial view excludes the outer wall of the head portion [22] as well as the peripheral wall [36] so that the the hub 48 and torque transfer clip 34 can be seen as they would be positioned relative to one another when a treatment assembly [16] is locked onto head portion [22].

The torque transfer clip 34 creates a standoff distance Ds between the base of the treatment assembly [16] and the face 52 of the hub 48. Due to its design, the torque transfer clip 34 creates a biasing force B pushing the two elements apart from one another. The importance of the biasing force is that it results in the amplification of the vibrations being transferred from the handpiece [12] and the treatment assembly [16] because it forces the pegs [40] to constantly be pressed with force against the edges of the channels at contact points 49. Furthermore, the "springiness" of the clip 34, combined with the standoff distance Ds, will allow for some flexing between the treatment assembly [16] and the face 52, as is depicted by arrow F. More specifics regarding the torque transfer clip 36 are provided below in FIGS. 12 and 13.

Figure 12:
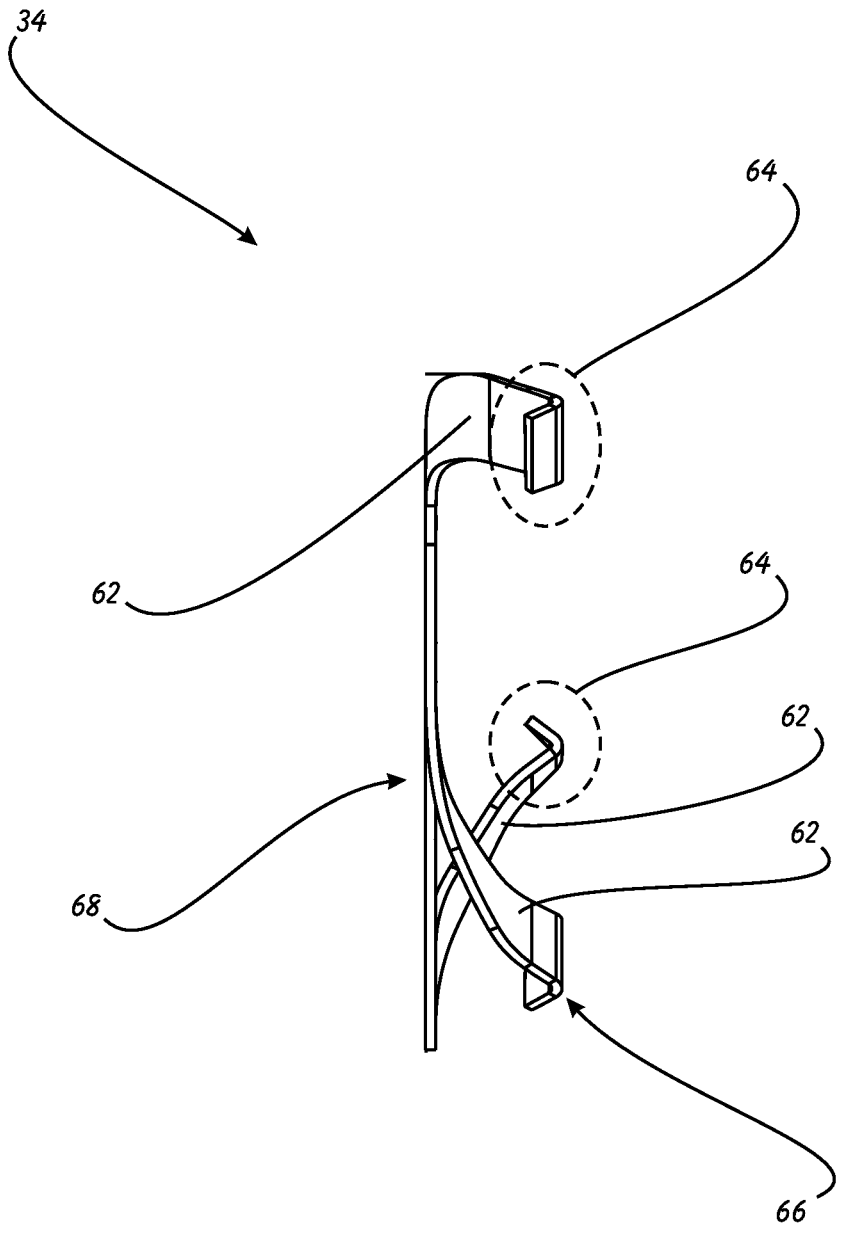
FIG. 12 is a side view of a preferred embodiment of the torque transfer clip of the device of FIG. 1.
Figure 13:
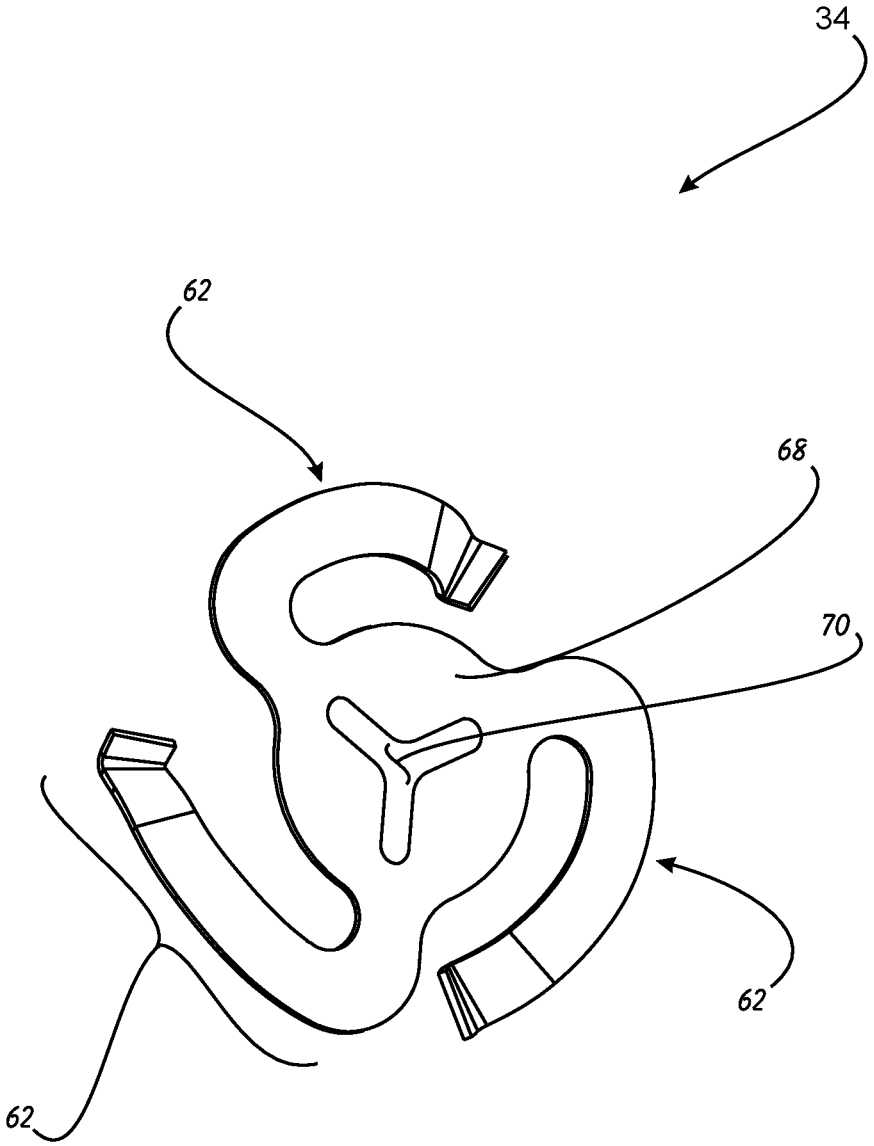
FIG. 13 is a rear perspective view of the clip of FIG. 12.

FIG. 12 is a side view of a preferred embodiment of the torque transfer clip 34 of the device [10] of FIG. 1. FIG. 13 is a bottom perspective view of the clip 34. As discussed above, the clip is preferably formed from flat spring steel or the like. The central base 68 has a 3-finned central aperture 70 at its center Two, three, or more arms 62 extend outwardly and are deflected upwardly from the central base 68. The arms 62 each terminate in a tip portion 64, with each tip portion having a ridge 66 bent into it. The ridge 66 provides a smooth surface with which the torque transfer clip 34 presses against the face [52] of the central hub [48]. A two-armed clip 34 and a four-armed clip 34 have also been tested and performed acceptably.

Figure 14:
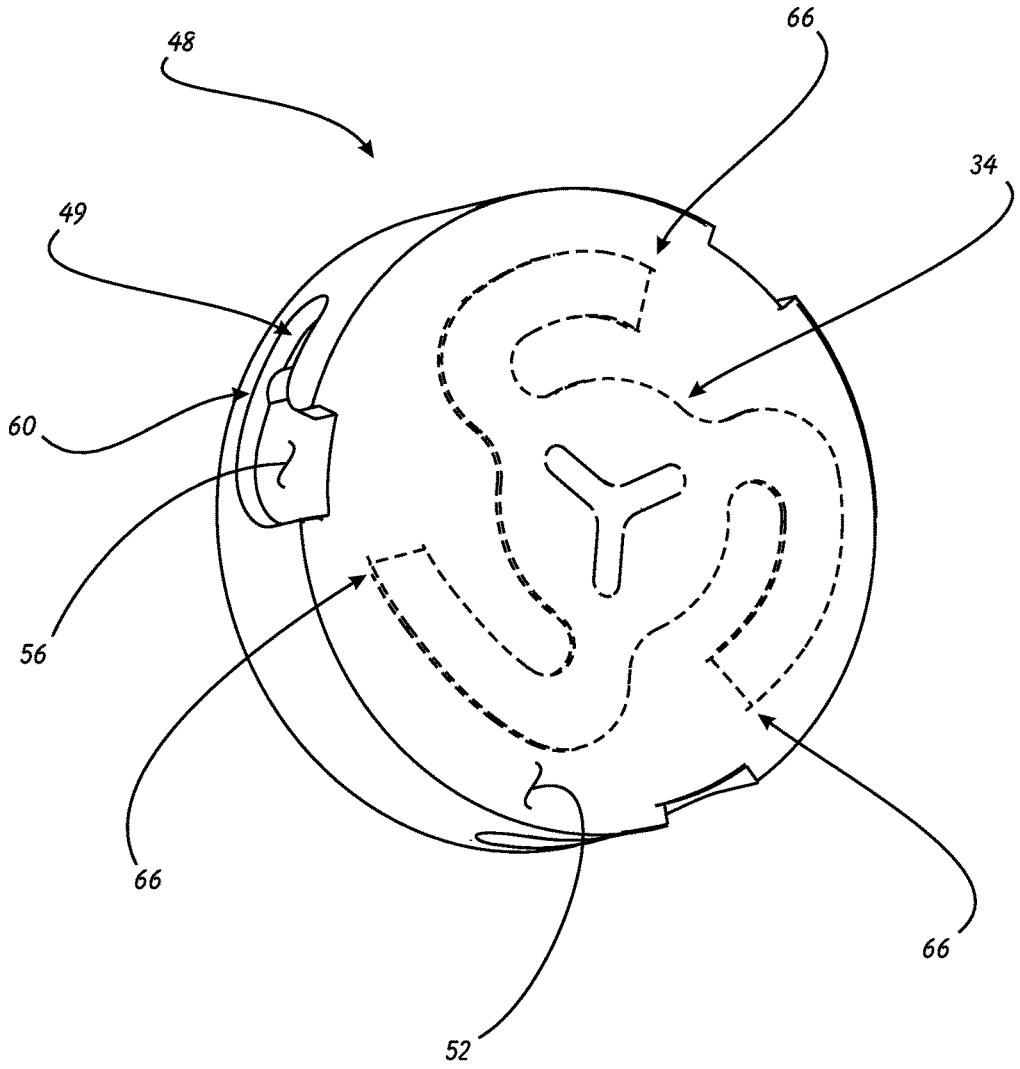
FIG. 14 is a rear perspective view of the head portion of the device of FIG. 1.

Finally turning to FIG. 14, which is a rear perspective view of the head portion [22] of the device [10] of FIG. 1, we can see how the clip 34 is oriented against the face 52 of the hub 48, so that the three ridges 66 are in contact with the face 52. The user must press the treatment assembly [16] against the hub 48 to compress the arms 62 of the clip 34 until the pegs [40] reside in the locking channels 56. The treatment assembly [16] is then twisted relative to the hub 48 until each peg [40] passes over the ridge 60 until it resides under the contact wall 49. The user can then release the pressure on the treatment assembly [16], after which the slight compression of the arms 62 will result in a biasing force [B] whereby the ridges 66 will push against the face 52 of the hub 48.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A facial treatment device, comprising:

a motor configured to rotate a terminal face of a central hub;

a handpiece defined by a head portion having a socket;

a treatment assembly configured to insert into said socket; and a torque transfer clip disposed between said terminal face and said treatment assembly, said torque transfer clip biasing said treatment assembly away from said terminal face, wherein said torque transfer clip is configured to transfer a torque from the motor to the treatment assembly.

2. The treatment device of claim 1, wherein said torque transfer clip comprises a central base in a first spatial plane and two or more flat arms extending upwardly from said first spatial plane.

3. The treatment device of claim 2, wherein each said flat arm of said torque transfer clip terminates in a tip portion, wherein each said tip portion defines a ridge formed by a crease in a flat material of said flat arm.

4. The treatment device of claim 1, wherein said socket is formed on said head portion, and comprises:

a central hub defining a face and a side wall;

a peripheral channel from which said central hub protrudes; and a rim adjacent to said peripheral channel.

5. The treatment device of claim 4, wherein said central hub has two or more L-shaped locking channels formed in said side wall, and said treatment assembly comprises a peripheral wall extending therefrom with two or more locking pegs extending inward from said peripheral wall, with said locking pegs located to cooperate with said L-shaped locking channels so as to interlock therewith to attach said treatment assembly to said central hub.

6. The treatment device of claim 5, wherein each said L-shaped locking channel is further defined by a ridge traversing said L-shaped locking channel in close proximity to a distal end of said L-shaped locking channel, whereby said ridge will restrain a said locking peg from sliding along said L-shaped locking channel.

7. The treatment device of claim 6, wherein each said L-shaped locking channels is defined by a groove commencing at a notch formed in said face of said central hub.

8. The treatment device of claim 7, wherein said treatment assembly comprises a base, a treatment element extending from one side of said base, and said torque transfer clip extending from an opposing side of said base, with said torque transfer clip attached to said base by a bonding stem extending through an aperture formed in said torque transfer clip.

9. A facial treatment device, comprising:

a motor configured to rotate a terminal face of a central hub;

a handpiece defined by a head portion, said head portion having a face defined by a rim and a peripheral channel formed adjacent to said rim;

a detachable treatment head, comprising:

a base defined by a first and second side;

a treatment element extending from said second side;

a peripheral wall extending from said first side; and a torque transfer clip attached to said base inside of said peripheral wall, whereby said torque transfer clip is disposed between said terminal face and said base when said treatment head is attached to said head portion, wherein said torque transfer clip is configured to transfer a torque from the motor to the treatment assembly.

10. The facial treatment device of claim 9, wherein a socket is formed on said head portion, and comprises:

a central hub defining a face and a side wall;

said peripheral channel from which said central hub protrudes; and said rim adjacent to said peripheral channel.

11. The facial treatment device of claim 10, wherein said central hub has two or more L-shaped locking channels formed in said side wall, and said treatment head comprises a peripheral wall extending therefrom with two or more locking pegs extending inward from said peripheral wall, with said locking pegs located to cooperate with said L-shaped locking channels so as to interlock therewith to attach said treatment head to said central hub.

12. The facial treatment device of claim 11, wherein each said L-shaped locking channel is further defined by a ridge traversing said L-shaped locking channel in close proximity to a distal end of said L-shaped locking channel, whereby said ridge will restrain a said locking peg from sliding along said L-shaped locking channel.

13. The facial treatment device of claim 12, wherein said torque transfer clip comprises a central base in a first spatial plane and two or more flat arms extending upwardly from said first spatial plane.

14. The facial treatment device of claim 13, wherein each said flat arm of said torque transfer clip terminates in a tip portion, wherein each said tip portion defines a ridge formed by a crease in a flat material of said flat arm.

15. A skin treatment device, comprising:

a motor;

an internal vibration generator;

a handpiece comprising a central hub defined by a face and a peripheral channel surrounding said central hub, the motor configured to rotate the face;

a treatment head comprising a base defined by opposing faces, and a peripheral wall extending from one said face, said peripheral wall comprising three or more pegs extending inwardly therefrom, whereby said pegs each engage a locking channel formed in a side surface of said hub to interlock said treatment head and said handpiece; and a torque transfer clip attached to said base within said peripheral wall whereby said torque transfer clip is compressed between the face and the base and biases said base away from said hub when said treatment head is attached to said handpiece, wherein said torque transfer clip is configured to transfer a torque from the motor to the treatment assembly.

16. The skin treatment device of claim 15, wherein said torque transfer clip comprises a central base in a first spatial plane and two or more flat arms extending upwardly from said first spatial plane.

17. The skin treatment device of claim 16, wherein each said flat arm of said torque transfer clip terminates in a tip portion, wherein each said tip portion defines a ridge formed by a crease in a flat material of said flat arm.

18. The skin treatment device of claim 17, wherein said central hub has three or more L-shaped locking channels formed in said side surface, and said treatment head comprises a peripheral wall extending therefrom with two or more locking pegs extending inward from said peripheral wall, with said locking pegs located to cooperate with said L-shaped locking channels so as to interlock therewith to attach said treatment head to said central hub.

19. The skin treatment device of claim 18, wherein each said L-shaped locking channels is further defined by a ridge traversing said L-shaped locking channel in close proximity to a distal end of said L-shaped locking channel, whereby said ridge will restrain a said locking peg from sliding along said L-shaped locking channel.

* * * * *